US006325835B1

(12) United States Patent
Shanks et al.

(10) Patent No.: US 6,325,835 B1
(45) Date of Patent: Dec. 4, 2001

(54) AIR-PURIFYING SYSTEM BLOWER MODULE WITH EXHAUST CHUTE

(75) Inventors: Anthony E. Shanks; Patrick J. Monnens, both of Prior Lake; Richard R. Bahn, Loretto, all of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/476,672

(22) Filed: Dec. 30, 1999

(51) Int. Cl.[7] ..... F04D 29/00; B01D 46/42

(52) U.S. Cl. ..... 55/467; 454/230; 416/146 R

(58) Field of Search ..... 55/413, 414, 415, 55/467, 472; 454/230; 415/53.1, 53.2, 53.3; 416/146 R

(56) References Cited

U.S. PATENT DOCUMENTS

| | | | | |
|---|---|---|---|---|
| 2,019,525 | * | 11/1935 | Dooley | 55/413 |
| 4,523,588 | | 6/1985 | Dolsky . | |
| 4,534,775 | | 8/1985 | Frazier . | |
| 5,302,354 | | 4/1994 | Watvedt et al. . | |
| 5,348,563 | | 9/1994 | Davis . | |
| 5,562,286 | | 10/1996 | Brinket . | |
| 5,673,747 | * | 10/1997 | Kousaka et al. | 415/53.1 |
| 5,942,323 | | 8/1999 | England . | |
| 5,961,702 | | 10/1999 | Doneit . | |

OTHER PUBLICATIONS

United Air Specialties, Inc., Advertisement Brochure entitled, "Crystal–Aire Modular Air Cleaning Systems", ©1992, pp. 1–4.

* cited by examiner

*Primary Examiner*—David A. Simmons
*Assistant Examiner*—Robert A. Hopkins
(74) *Attorney, Agent, or Firm*—Dicke, Billig & Czaja, P.A.

(57) ABSTRACT

A blower module for use with a commercial air-purifying system. The blower module includes a housing, a blower unit and a chute. The housing defines an inlet region and an outlet region. The inlet region forms an intake port. The outlet region forms a supply port and an exhaust port. The blower unit is maintained within the housing, such that operation of the blower generates an airflow within the housing from the inlet region to the outlet region. Finally, the chute is mounted within the outlet region adjacent the exhaust port and is configured to direct a portion of the airflow to the exhaust port. With this configuration, an overall size of the blower module housing is greatly reduced.

27 Claims, 5 Drawing Sheets

AIR-PURIFYING SYSTEM BLOWER MODULE WITH EXHAUST CHUTE

BACKGROUND OF THE INVENTION

The present invention relates to a blower module for use with a commercial air-purifying system. More particularly, it relates to a blower module incorporating an exhaust chute for directing airflow to an associated exhaust port during operation.

In recent years, there has been a growing interest to improve environmental air conditions in homes and in commercial settings, such as offices, restaurants, taverns, bowling alleys, hospitals, laboratories, lavatories, and the like. As more information has been made available to the public concerning the hazards of indoor air pollution, there has been an increased demand for filtering devices that can be used to effectively improve air quality.

A self-contained, stand-alone air cleaning or filtration unit is normally employed to clean air in both residential and commercial settings. Stand-alone air filtration units can assume a wide variety of forms, but generally include a housing maintaining one or more applicable filter materials and a fan or blower unit. The housing defines an inlet, at which the filter(s) is disposed, as well as an outlet or exhaust port. Most commercial applications include a false ceiling, such that the housing is readily "hidden" above the ceiling, with only the inlet (or an associated grille) being visible to persons within the room. During use, the fan or blower unit is operated to draw room air through the filter via the inlet. The filter material or media removes undesirable air-borne particles and/or gaseous contaminants or odors, such as dust, smoke, pollen, molds, tobacco odor, volatile organic compounds (VOCs), etc., from the airflow. Following interaction with the filter material, the now "cleansed" air is forced, via the blower, back into the room through the outlet port. A continuous intake and supply of air preferably generates a desired air re-circulation pattern within the room.

An alternative concept to the stand-alone filtration unit is a modular air-purification system. With this configuration, a blower module, one or more filter modules and one or more supply modules are separately provided and installed over a room of interest. The blower module includes a blower unit and is fluidly connected to the filter module(s) and the supply module(s) by standard ductwork. Perhaps due to the industry acceptance of self-contained air-filtration units, as well as the engineering obstacles present by a modular configuration, only one modular-type air cleaning system has been identified, advertised as being available under the trade name Crystal-Aire® from United Air Specialties, Inc. of Cincinnati, Ohio. According to a trade brochure, this air cleaning system apparently includes separate blower and filter units designed to be connectable by a single duct. This configuration allows the blower unit to be installed apart from the filter unit. However, the blower unit has only one inlet port and one outlet port, such that the system is restricted to a single filter unit connected to the inlet port, and a single supply (or forced air return) unit connected to the outlet port. In theory, it may be possible to cormect two or more filter units and/or supply units in series to the blower unit. Unfortunately, overall blower efficiency may be greatly reduced.

An additional concern associated with a modular air-purification system apparently not addressed by the described Crystal-Air® product is a need to exhaust air from the blower module apart from air directed through the supply module. When installed over a room of interest, room air is drawn through the filter module, cleansed, and then returned to the room via the supply module. For many applications, it is desirable to maintain a negative pressure differential within the room for more efficient air circulation. This concept is apparently not addressed by the Crystal-Aire® system. However, in accordance with designs of other available commercial air handling units, an exhaust port separate from the outlet port associated with the supply module could be formed in the blower module housing, with a portion of the filtered air being exhausted through the exhaust port to an area outside the room of interest. To ensure airflow through the exhaust port, the accepted design technique is to form a relatively large exhaust plenum within the unit's housing (in addition to an inlet plenum for drawing air into the housing). The large volume of the exhaust plenum is required to establish a static pressure within the plenum, so that an acceptable volume of air will exit from the housing through both the outlet port and the exhaust port.

Air-purifying system are extremely popular and beneficial. While stand-alone, self-contained air filtration units are widely accepted, modular air-purifying systems appear highly viable. However, certain potential drawbacks, such as efficient, low-cost exhaust requirements remain unresolved. Therefore, a need exists for a blower module for use with an air-purifying system incorporating a low-cost, reduced-sized exhaust configuration.

SUMMARY OF THE INVENTION

One aspect of the present invention relates to a blower module for use within an air-purifying system. The blower module includes a housing, a blower unit and a chute. The housing defines an inlet region and an outlet region. The inlet region forms an intake port. The outlet region forms a supply port and an exhaust port. The blower unit is maintained within the housing such that operation of the blower unit generates an airflow from the inlet region to the outlet region. Finally, the chute is mounted within the outlet region adjacent the exhaust port. In this regard, the chute is configured to direct a portion of the airflow to the exhaust port. The so-configured blower module can be used as part of an air-purifying system whereby a filter module is fluidly connected to the intake port, a supply module is fluidly connected to the supply port and exhaust ductwork is fluidly connected to the exhaust port. Operation of the blower causes air to be drawn through the filter module and into the housing via the intake port. Airflow within the housing is directed to the outlet region. A majority of the airflow is forced outwardly from the blower module via the supply port/supply module. A portion of the airflow, however, is directed by the chute into the exhaust port. In one preferred embodiment, the chute is selectively movable within the housing such that an operator can dictate a desired airflow volume through the exhaust port and/or desired pressure drop over a length of the exhaust ductwork.

Another aspect of the present invention relates to an air-purification system. The system includes a blower module, a filter module, a supply module and exhaust ductwork. The blower module includes a housing, a blower unit and a chute. The housing defines an inlet region and an outlet region. The inlet region forms an intake port. The outlet region forms a supply port and an exhaust port. The blower unit is maintained within the housing such that operation of the blower generates an airflow from the inlet region to the outlet region. The chute is mounted within the outlet region adjacent the exhaust port, and is configured to direct a portion of the airflow to the exhaust port. The filter module is fluidly connected to the blower module via the intake port. Similarly, the supply module is fluidly connected to the blower module via the supply port. Finally, the exhaust ductwork is fluidly connected to the exhaust port. With this configuration, the system is installable over a room of interest, with the filter module and supply module positioned to receive air from, and supply air to, the room, respectively, and the exhaust ductwork extending away from the room. Operation of the blower draws air into the filter module, and directs air out of the blower module via the supply module and the exhaust ductwork. In one preferred embodiment, the air-purification system includes two filter modules and four supply modules. The filter modules are fluidly connected to the blower module via respective intake ports, whereas the supply modules are fluidly connected to the blower module via respective supply ports.

Yet another aspect of the present invention relates to a blower module for use with an air-purifying system. The blower module comprises a housing, a blower unit and a chute. The housing defines an inlet region and an outlet region. The inlet region forms an intake port. The outlet region forms a supply port and an exhaust port. The blower unit is maintained within the housing such that operation of the blower unit creates an airflow from the inlet region to the outlet region. In this regard, the supply port is located in relatively close proximity to the blower unit such that airflow is forced into the supply port via a velocity pressure of the airflow. Finally, the chute is mounted within the outlet region for directing a portion of the airflow to the exhaust port. With this configuration, the chute diverts a portion of the airflow velocity pressure into the exhaust port, thereby minimizing a size of the housing.

DESCRIPTION OF THE PREFERRED EMBODIMENTS

Figure 1:
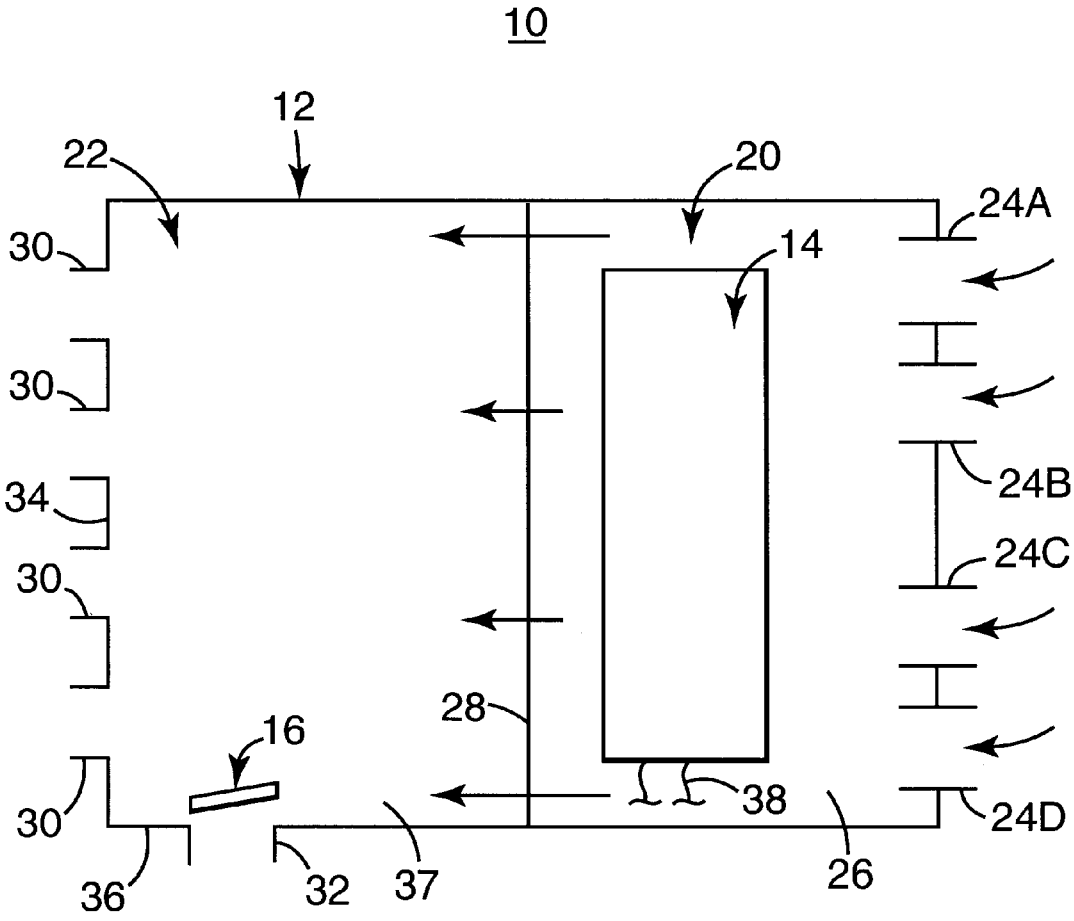
FIG. 1 is a schematic view of a blower module in accordance with the present invention.

One preferred embodiment of a blower module 10 in accordance with the present invention is shown schematically in FIG. 1. Blower module 10 is configured for use with an air-purifying system (not shown) and includes a housing 12, a blower unit 14 and a chute 16. Details on the various components are provided below. Generally speaking, however, blower unit 14 and chute 16 are maintained within housing 12 for generating and directing airflow within housing 12.

Housing 12 is made of a rigid material, such as galvanized steel, stainless steel, aluminum or plastic, and is sized to encompass blower unit 14. In this regard, housing 12 defines a first or inlet region 20 and a second or outlet region 22. Blower unit 14 is maintained within inlet region 20. Further, inlet region 20 forms at least one intake port. In a preferred embodiment, housing 12 forms four-intake ports 24A–24D, situated in pairs for fluid connection to two filter modules (not shown), although alternatively any other number is acceptable. Finally, inlet region 20 forms an intake plenum chamber 26, formed, in part, by a plenum plate 28, as known in the art.

Outlet region 22 is formed downstream of inlet region 20 and forms supply ports 30 and an exhaust port 32. In one preferred embodiment, four of supply ports 30 are provided, although any other number is equally acceptable. Similarly, more than one exhaust port 32 may be provided. Although shown schematically in FIG. 1, supply ports 30 are preferably formed in a first wall 34 of housing 12; whereas exhaust port 32 is formed in a second wall 36. First wall 34 is preferably perpendicular to second wall 36 and defines a downstream end of housing 12. Thus, supply ports 30 are perpendicular to exhaust port 32. Plenum plate 28 establishes an outlet plenum chamber 37 within outlet region 22. However, for reasons described in greater detail below, outlet plenum chamber 37 is of a greatly reduced size.

Blower unit 14 can assume a wide variety of forms, and in one preferred embodiment is a ⅓ horsepower motorized blower. As is well known in the art, other differently sized motors, offering either greater or less power, can also be utilized. Even further, a plurality of blower units 14 can be provided. Additionally or alternatively, one or more fans, such as centrifugal fans, can be employed. Regardless, blower module 10 preferably further includes a means for relaying electrical power to blower unit 14. Relaying means can include an electrical power input (not shown) configured to receive a plug of an extension cord or the like and may be plugged into an electrical outlet. Alternatively, blower unit 14 can be hard wired to a separately available power source upon installation, such as by wiring 38.

With the above-described configuration of housing 12 and blower unit 14 in mind, operation of blower unit 14 draws air into housing 12 via intake ports 24A–24D (represented by arrows in FIG. 1). Additionally, blower unit 14 generates an airflow from inlet region 20 to outlet region 22, again represented by arrows in FIG. 1. The so-directed air is forced from housing 12 via supply ports 30 and exhaust port 32. In this regard, first wall 34, and thus supply ports 30, is positioned generally perpendicular to the airflow direction such that the airflow enters supply ports 30 directly. Conversely, second wall 36 is orientated in a plane generally parallel to airflow within outlet region 22, such the airflow does not enter exhaust port 32 directly. Instead, chute 16 is disposed within the airflow to direct a portion of the airflow through exhaust port 32. It will be noted that first wall 34, and thus supply ports 30, is located in relatively close proximity to blower unit 14, such that a velocity pressure of the airflow causes the airflow to enter supply ports 30. This is in direct contrast to "standard" air handling unit housing designs whereby the supply ports must be positioned at a relatively large distance from the blower unit so that a static pressure (as opposed to a velocity pressure) is established within the outlet plenum chamber for facilitating relatively uniform airflow through the supply ports and the exhaust port. Thus, by incorporating chute 16, an overall size of outlet plenum chamber 37 can be greatly reduced, as a static pressure within outlet plenum chamber 37 is not required. Chute 16 diverts a portion of the velocity pressure directly into exhaust port 32.

Figure 2:
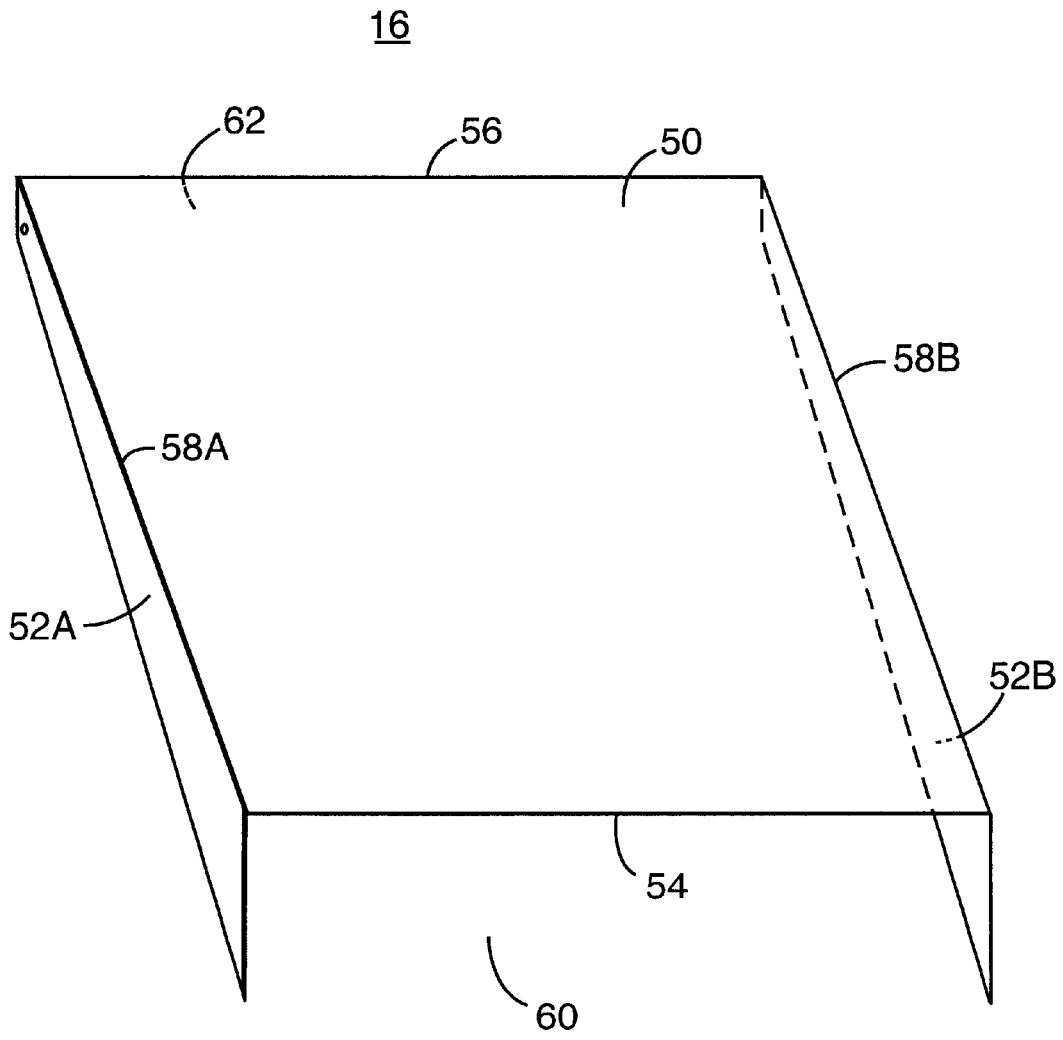
FIG. 2 is a perspective view of a chute used in conjunction with the blower module of FIG. 1.

Chute 16 is shown in greater detail in FIG. 2. Chute 16 includes a face panel 50 and opposing side panels 52A, 52B. Face panel 50 defines an upstream end 54, a downstream end 56 and opposing edges 58A, 58B. Opposing side panels 52A, 52B extend downwardly from face panel 50 along opposing edges 58A, 58B, respectively. In a preferred embodiment, side panels 52A, 52B are substantially perpendicular to face panel 50. In this regard, a downward extension or height of opposing side panels 52A, 52B is preferably greater at upstream end 54 than at downstream end 56. Thus, opposing side panels 52A, 52B taper in height from upstream end 54 to downstream end 56. Extension of side panels 52A, 52B from face panel 50 generates an upstream opening or gap 60 and a downstream opening or gap 62 in chute 16. As described in greater detail below, upstream gap 60 and downstream gap 62 facilitate passage of airflow through chute 16. It should be understood that the terms "upstream" and "downstream" (e.g., upstream end 54, downstream end 56, upstream gap 60 and downstream gap 62) are in reference to a final orientation of chute 16 within housing 12 (FIG. 1) relative to the airflow direction indicated in FIG. 1.

Returning to FIG. 2, chute 16 is preferably integrally formed from a rigid material, such as steel, aluminum, plastic, etc. In one preferred embodiment, chute 16 is formed from 20-gage galvanized steel. Further, chute 16 is sized in accordance with a size of exhaust port 32 (FIG. 1) previously described. In a preferred embodiment, chute 16 has an overall size approximating or slightly greater than a cross-sectional area of exhaust port 32. Thus, in one preferred embodiment, face panel 50 has a length (or extension between upstream end 54 and downstream end 56) in the range of 5–10 inches; most preferably approximately 7.5 inches. Additionally, face panel 50 has a width (or extension between opposing edges 58A, 58B) in the range of approximately 5–10 inches; most preferably 8 inches. Finally, each of opposing side panels 52A, 52B preferably tapers in height (or extension from face panel 50) from upstream end 54 to downstream end 56. In this regard, a height of each of opposing side panels 52A, 52B at upstream end 54 is in the range of approximately 1.5–2.5 inches, most preferably 2 inches; whereas a height (or extension from face panel 50) at downstream end 56 is in the range of approximately 0.5–1 inch, most preferably 0.75 inch. Alternatively, however, other dimensions, preferably corresponding with a size of exhaust port 32 are equally acceptable.

Figure 3:
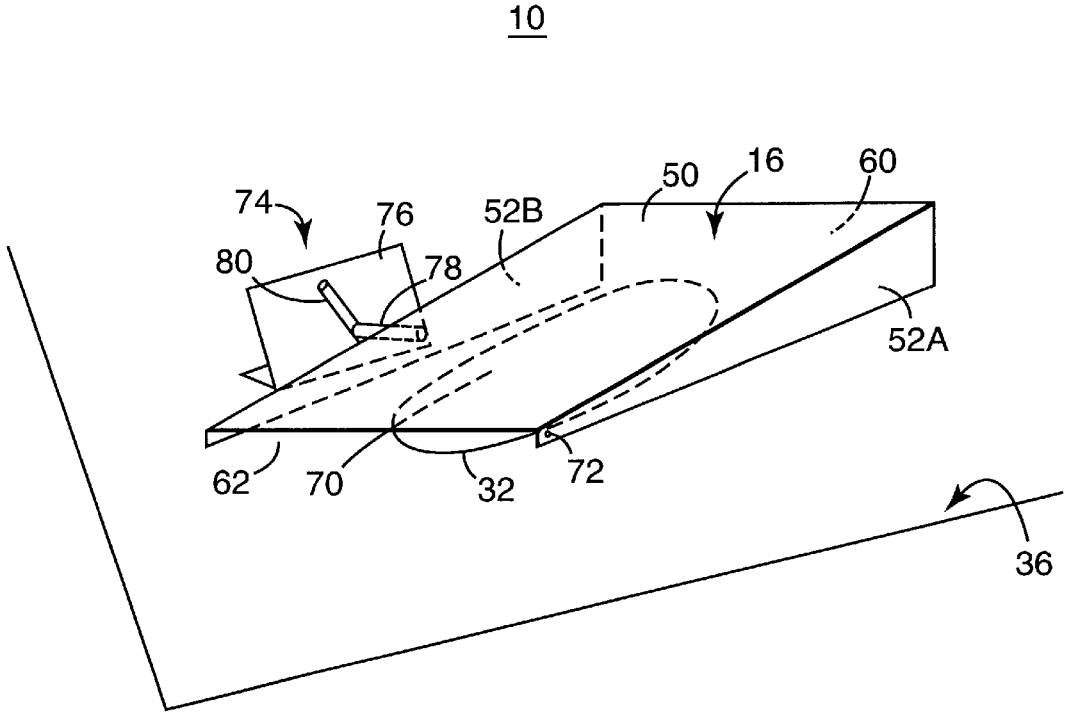
FIG. 3 is a perspective view of the chute of FIG. 2 in conjunction with a portion of a blower module housing.

Assembly of chute 16 within outlet region 22 of housing 12 is shown in FIG. 3. For ease of illustration, only a portion of outlet region 22, and in particular second wall 36, is shown. Chute 16 is preferably mounted to second wall 36 such that chute 16 is generally aligned with, but slightly space from, exhaust port 32. More particularly, face panel 50 is transversely spaced from second wall 36, and thus exhaust port 32. Further, chute 16 is orientated such that opposing side panels 52A, 52B extend toward second wall 36, and thus exhaust port 32. With this configuration, chute 16 defines an exhaust air stream region 70 relative to exhaust port 32. Effectively, face panel 50 defines a leading side (or top side relative to the orientation of FIG. 3) of exhaust air stream region 70, whereas opposing side panels 52A, 52B define transverse sides thereof. In addition to the opening defined by exhaust port 32, exhaust air stream region 70 is preferably open at both upstream gap 60 and downstream gap 62. As described below, airflow is allowed to exit exhaust air stream region 70 via exhaust port 32 and downstream gap 62. This configuration facilitates a generally laminar (or less turbulent) flow within exhaust air stream region 70, thereby minimizing noise and other problems associated with more turbulent airflow.

In one preferred embodiment, chute 16 is pivotally secured within housing 12 by pins 72 connecting opposing side panels 52A, 52B adjacent downstream end 56 to side wall 36. Additionally, in one preferred embodiment, blower module 10 includes an adjustment device 74 connecting one of opposing side panels (for example, side panel 52B) to second wall 36. In a preferred embodiment, adjustment device 74 includes a bracket 76 and a finger 78. Bracket 76 forms a slot 80 sized to receive finger 78. Finger 78, in turn, extends between, and is connected to, bracket 76 and opposing side panel 52B. Finger 78 is sized to be securable within slot 80. With this configuration, movement of within 78 within slot 80 dictates an angular orientation of chute 16 relative to second wall 36, and thus relative to exhaust port 32.

Figure 4:
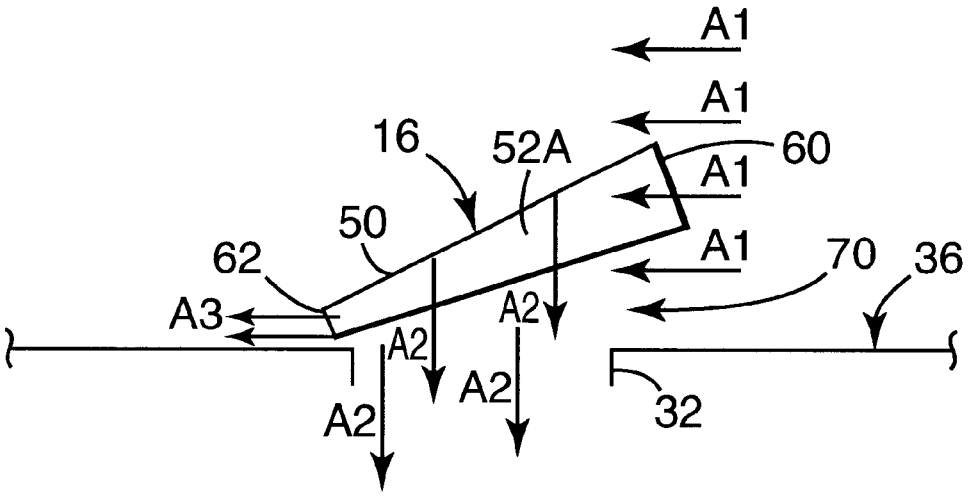
FIG. 4 is a side view of FIG. 3, illustrating airflow within the blower module.

Direction of airflow within exhaust air stream region 70 is best illustrated in FIG. 4. Once again, chute 16 is orientated such that face panel 50 is aligned with, but transversely spaced from, exhaust port 32. Further, opposing side panels 52A, 52B (only side panel 52A is shown in FIG. 4) extend from face panel 50 toward exhaust port 32. Face panel 50 is preferably orientated at an angle relative to a plane defined by second wall 36. A transverse spacing of upstream end 54 from second wall 36 is preferably greater than the transverse spacing of downstream end 56. With this orientation, face panel 50 and side panels 52A, 52B project into the airflow (designated generally by arrows A1) within outlet region 22. A portion of airflow A1 is guided into exhaust air stream region 70 by chute 16 at upstream gap 60. A majority of airflow within exhaust air stream region 70 interacts with and is directed by chute 16 into exhaust port 32 (represented by arrows A2). In addition, a segment of airflow within exhaust air stream region 70 exits via downstream gap 62 (designated by arrows A3). Thus, by allowing a segment of airflow to pass through chute 16, airflow within exhaust air stream region 70 is less turbulent, preferably generally laminar. By reducing turbulent airflow within exhaust air stream region 70, noise within blower module 10 is minimized.

As will be understood by one of ordinary skill in the art, by altering an angular orientation of chute 16 relative to second wall 36 and exhaust port 32 (such as by adjustment device 74 of FIG. 3), the volume of airflow forced toward exhaust port 32 can be pre-selected by a user to satisfy the needs of a particular air handling application. For example, where increased airflow through exhaust port 32 is desired, chute 16 can be pivoted such that a transverse spacing between upstream end 54 of face panel 50 and second wall 36 is increased. This increased spacing generates a larger cross-sectional area for upstream gap 60 (relative to second wall 36), thereby increasing a volume of airflow A1 entering exhaust air stream region 70 (and thus being exhausted via exhaust port 32). Conversely, by decreasing a transverse spacing between upstream end 54 and second wall 36, a lesser volume of airflow A1 will enter exhaust air stream region 70 and therefore be exhausted from exhaust port 32. Further, as described below, by adjusting an orientation of chute 16, a pressure drop across a length of ductwork (not shown) connected to exhaust port 32 can be optimized.

Use of chute 16 greatly reduces a requisite size of outlet plenum chamber 37, and thus of housing 12. By positioning chute 16 within airflow A1, a sufficient volume of airflow velocity pressure within outlet region 22 is forced to exit blower module 10 via exhaust port 32. Effectively, implementation of chute 16 reduces a resulting size of housing 12 by ¼. For example, with the preferred embodiment blower module 10 incorporating four intake ports 24A–24D (FIG. 1), four supply ports 30 (FIG. 1) and ⅓ horsepower blower unit 14, a size of housing 12 is approximately 16 inches by 16 inches by 32 inches; as opposed to a "standard" housing, requiring a static pressure within outlet plenum chamber 37, that would have a size on the order of 16 inches by 16 inches by 48 inches.

Figure 5:
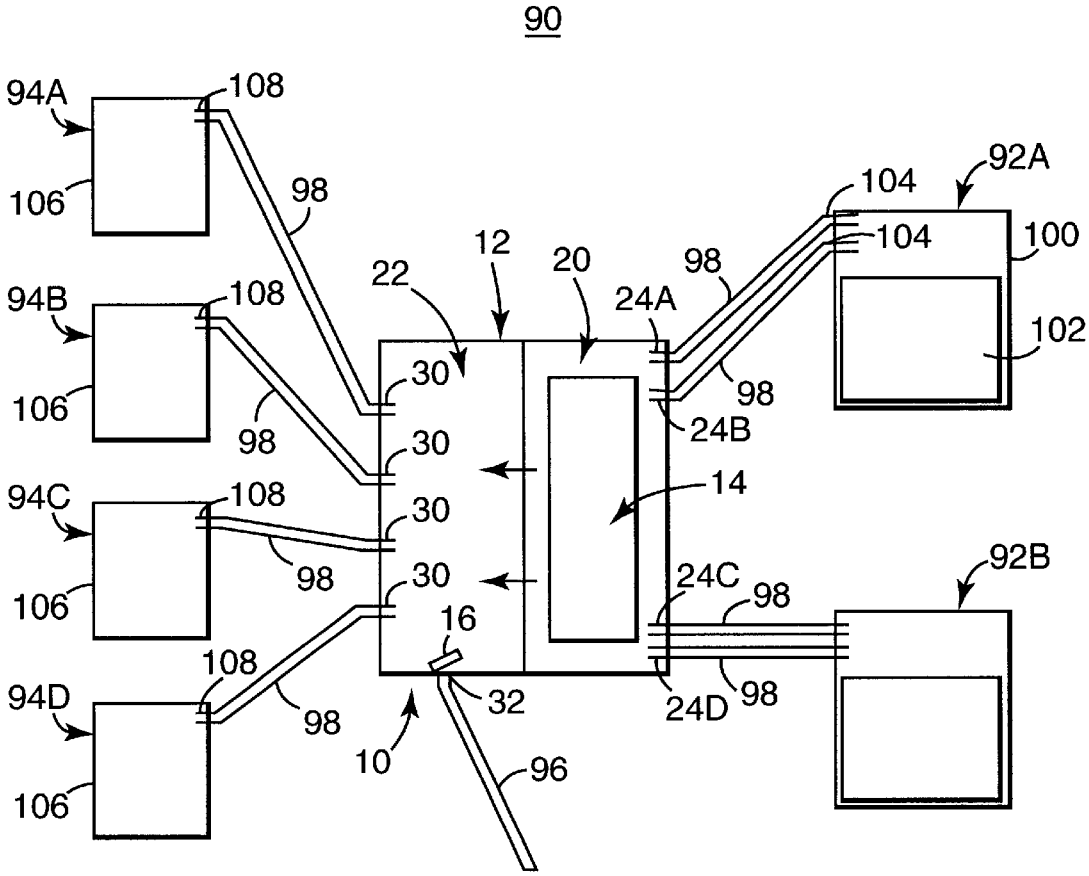
FIG. 5 is a schematic illustration of an air-purifying system incorporating a blower module in accordance with the present invention.

The above-described blower module 10 can be used in conjunction with an air-purifying system, such as air-purifying system 90 depicted in FIG. 5. Air-purifying system 90 includes blower module 10, filter modules 92A, 92B, supply modules 94A–94D and exhaust ductwork 96. Each of filter modules 92A, 92B, and supply modules 94A–94D are fluidly connected to blower module 10 via ductwork 98.

Filter modules 92A, 92B can assume a wide variety of forms and are preferably identical. In one preferred embodiment, filter modules 92A, 92B include a housing 100 maintaining filter media 102. Housing 100 preferably forms a pair of exhaust ports 104 configured for fluid connection to ductwork 98. For example, with reference to filter module 92A, outlets 104 are fluidly connected to intake ports 24A, 24B of blower module 10 via pair of ducts 98. Alternatively, filter modules 92A, 92B can each be fluidly connected to blower module 10 by a single duct, respectively. Depending upon the particular application, filter media 102 may assume a wide variety of forms and/or combinations of different filters. For example, in one preferred embodiment, filter media 102 includes a pre-filter, such as a lightweight, low efficiency (on the order of 15% dust spot efficiency) impingement filter, a primary particulate filter and a sorbent material filter. Particulate filters are employed to remove large fibers or particles, such as pollen, molds, bacteria, etc. A well-known example of an acceptable primary particulate filter is a high efficiency particulate arrestance (HEPA) filter. HEPA filters have a minimum efficiency of 99.97% relative to 0.3 micron dioctyl phthalate (DOP) particles, it being understood that other, lower efficiency filters, are equally acceptable. Sorbent material filters are also well-known in the art, and provide enhanced filtering of gaseous contaminants and odors (e.g., tobacco smoke odors, cooking odors, volatile organic compounds (VOCs), etc.). Sorbent material filters typically include a relative large volume of an appropriate sorbent material, or combination of sorbent materials, in either granular or impregnated form. The sorbent material adsorbs gaseous contaminants and odors. Sorbent materials identified as being most effective in removing odors include charcoal or carbon, potassium permanganate and zeolite. In fact, an extremely popular sorbent material is available under the trade name CPZ™, generally composed of 60% charcoal or carbon, 20% potassium permanganate and 20% zeolite. Alternatively, filter modules 92A, 92B may include other known filter medias.

Supply modules 94A–94D can assume a wide variety of forms (e.g., shape, size and construction), and are preferably identical in construction. In this regard, supply modules 94A–94D each include a housing 106 forming an inlet 108. Inlet 108 is configured to be fluidly connected to a respective one of supply ports 30 formed in blower module 10.

Exhaust ductwork 96 is fluidly connected to exhaust port 32 of blower module 10. In this regard, exhaust ductwork 96 can simply terminate in an open end, or instead may include an exhaust module similar to supply module 94A–94D.

During use, air-purifying system 90 is installed over a room or rooms of interest. In particular, filter modules 92A, 92B are installed to receive air from the room of interest; whereas supply modules 94A–94D are installed to direct air back into the room of interest. Exhaust ductwork 96, on the other hand, extends away from the room of interest, exhausting air outside the room. Once installed, blower unit 14 is operated to draw room air into filter modules 92A, 92B for interaction with filter media 102. The now "cleansed" air is directed, via blower unit 14 and ductwork 98, into housing 12 at intake ports 24A–24D. Blower unit 14 then directs airflow within housing 12 from inlet region 20 to outlet region 22. A majority of airflow is forced out of housing 12 via supply ports 30 to supply modules 94A–94B. As previously described, however, chute 16 directs a portion of the airflow through exhaust port 32 and thus to exhaust ductwork 96.

Use of chute 16 in conjunction with exhaust port 32 generates a negative pressure within the room of interest. By way of example, an air-purifying system was constructed in accordance with the preferred embodiment of FIG. 5, incorporating a blower module 10 having a ⅓ horsepower blower unit 14, and filter modules 92A, 92B each including both a HEPA filter and a sorbent material filter having approximately 10 pounds of CPZ™. Operation of blower unit 14 at approximately 1600 RPM generated a volumetric airflow rate of in the range of approximately 400–800 cubic feet per minute (CFM), most preferably approximately 575 CFM, for each of filter modules 92A, 92B. Additionally, an airflow rate of in the range of approximately 100–320 CFM, most preferably approximately 230 CFM, was achieved for each of supply modules 94A–94D and exhaust ductwork 96. Other volumetric airflow rates can alternatively be achieved depending upon a size of blower unit 14, as well as an overall configuration of air-purifying system 10. Notably, by altering an orientation of chute 16, a desired pressure drop across a length of exhaust ductwork 96 can be achieved. That is to say, where exhaust ductwork 96 is relatively long, chute 16 can be positioned to increase airflow into exhaust port 32, to provide a desired pressure drop.

The blower module of the present invention provides a marked improvement over previous designs. In particular, by providing the blower module with a chute configured to direct airflow through an exhaust port, a size of the outlet plenum is greatly reduced. In a preferred embodiment, an orientation of the chute relative to the exhaust port is variable, such that a user can select a desired exhaust airflow volume in accordance with a particular commercial application. Finally, by forming the chute to allow for limited airflow therethrough (such as by a downstream opening or gap), operation of the blower module generates little additional noise.

Although the present invention has been described with reference to preferred embodiments, workers skilled in the art will recognize that changes may be made in form and detail without departing from the spirit and scope of the present invention. For example, the blower module has been described as forming a plurality of intake ports and a plurality of supply ports. This preferred design is in accordance with one preferred embodiment of an air-purifying system, which incorporates two filter modules and four supply modules. Alternatively, however, the air-purifying system need only incorporate a single filter module and a single supply module. With this approach, the blower module need only form a single intake port and a single supply port. Further, while the chute has been preferably described as being adjustable relative to the exhaust port, the chute can be more permanently installed.

What is claimed is:

1. A blower module for use with a commercial air-purifying system, said blower module comprising:

a housing defining an inlet region and an outlet region, said inlet region forming an intake port and said outlet region forming a supply port and an exhaust port;

a blower unit maintained within said housing, wherein operation of said blower unit generates an airflow within said housing from said inlet region to said outlet region; and a chute mounted within said outlet region adjacent said exhaust port, said chute including a face panel and side panels extending from opposing edges of said face panel, wherein said chute being configured to direct a portion of said airflow to said exhaust port.

2. The blower module of claim 1, wherein said exhaust port is formed in a first wall of said housing, and further wherein said face panel is positioned at an angle relative to said first wall to establish an exhaust air stream region between said face panel and said exhaust port.

3. The blower module of claim 2, wherein said chute defines an upstream gap relative to said first wall for allowing airflow to enter said exhaust air stream region.

4. The blower module of claim 3, wherein said chute further defines a downstream gap relative to said first wall for allowing a portion of airflow entering said exhaust air stream region to exit said exhaust air stream region such that airflow within said exhaust air stream region is generally laminar.

5. The blower module of claim 3, wherein said chute being orientated such that said side panels project from said face panel toward said first wall for defining transverse sides of said exhaust air stream region.

6. The blower module of claim 5, wherein each of said side panels are substantially perpendicular to said face panel.

7. The blower module of claim 2, wherein said chute is pivotally mounted within said housing such that an angle of said face panel relative to said first wall is selectively variable.

8. The blower module of claim 7, wherein said blower module further includes an adjustment device connected to said chute for dictating an angle of said face panel relative to said first wall.

9. The blower module of claim 8, wherein said adjustment device includes:

a mounting bracket forming a slot; and a finger extending from said chute to said slot, wherein said finger is configured to be selectively secured within said slot.

10. The blower module of claim 2, wherein said first side wall extends in a plane generally parallel with said airflow.

11. The blower module of claim 10, wherein said supply port is formed in a second wall of said housing, said second wall being substantially perpendicular to said airflow.

12. The blower module of claim 1, wherein said inlet region forms a plurality of intake ports.

13. The blower module of claim 1, wherein said outlet region forms a plurality of supply ports.

14. A commercial air-purifying system comprising:

a blower module comprising:

a housing defining an inlet region and an outlet region, said inlet region forming an intake port and said outlet region forming a supply port and an exhaust port, a blower unit maintained within said housing, wherein operation of said blower unit generates an airflow within said housing from said inlet region to said outlet region, a chute mounted within said outlet region adjacent said exhaust port, said chute including a face panel and side panels extending from opposing edges of said face panel, wherein said chute is configured to direct a portion of said airflow to said exhaust port;

a filter module fluidly connected to said blower module via said intake port;

a supply module fluidly connected to said blower module via said supply port; and an exhaust duct fluidly connected to said blower module via said exhaust port;

wherein operation of said blower unit draws air into said filter module and directs air out of said supply module and said exhaust duct.

15. The air-purifying system of claim 14, wherein said exhaust port is formed in a first wall of said housing, and further wherein said face panel is positioned at an angle relative to said first wall to establish an exhaust air stream region between said face panel and said exhaust port.

16. The air-purifying system of claim 15, wherein said chute defines an upstream gap relative to said first wall for allowing air into said exhaust air stream region.

17. The air-purifying system of claim 16, wherein said chute further defines a downstream gap relative to said first wall for allowing a portion of airflow entering said exhaust air stream region to exit said exhaust air stream region such that airflow within said exhaust air stream region is generally laminar.

18. The air-purifying system of claim 15, wherein said chute being orientated such that said side panels project from said face panel toward said first wall for defining transverse sides of said exhaust air stream region.

19. The air-purifying system of claim 15, wherein said chute is pivotally mounted within said housing such that an angle of said face panel relative to said first wall is selectively variable.

20. The air-purifying system of claim 14, wherein said inlet section of said housing forms two intake ports, said filter module being fluidly connected to said blower module via said two intake ports.

21. The air-purifying system of claim 14, wherein said outlet section of said housing forms a plurality of supply ports, said system further comprising:

a plurality of supply modules fluidly connected to said blower module via one of said supply ports, respectively.

22. A blower module for use with a commercial air-purifying system, said blower module comprising:

a housing defining an inlet region and an outlet region, said inlet region forming an intake port and said outlet region forming a supply port and an exhaust port;

a blower unit maintained within said housing in relatively close proximity to said supply port, wherein operation of said blower unit creates an airflow from said inlet region to said outlet region; and a chute mounted within said outlet region, said chute including a face panel and side panels extending from opposing edges of said face panel, wherein said chute directs a portion of said airflow to said exhaust port;

wherein an airflow pressure within said outlet region is not static.

23. The blower module of claim 22, wherein an exhaust air stream region is defined between said chute and said exhaust port, said chute forming an upstream gap and a downstream gap such that said portion of said airflow enters said exhaust air stream region at said upstream gap.

24. The blower module of claim 23, wherein said downstream gap is configured to allow airflow to exit said exhaust air stream region, such that airflow within said exhaust air stream region is generally laminar.

25. The blower module of claim 23, wherein said chute is configured such that an upstream cross-sectional area of said exhaust air stream region is selectively variable.

26. The blower module of claim 22, wherein said chute being disposed within said housing such that said face panel is aligned with, and transversely spaced from, said exhaust port.

27. The blower module of claim 26, wherein said side panels extend from said face panel toward said exhaust port.

* * * * *